United States Patent [19]

Magera

[11] 4,424,028

[45] Jan. 3, 1984

[54] REINFORCED INSULATION FOR WATER COOLED PIPES

[76] Inventor: Matthias R. Magera, 311 Hawthorne Sq., Oakdale, Pa. 15071

[21] Appl. No.: 296,642

[22] Filed: Aug. 27, 1981

[51] Int. Cl.[3] ..... F27D 3/02

[52] U.S. Cl. ..... 432/234; 138/158; 138/163

[58] Field of Search ..... 432/234; 138/147, 158, 138/161, 162, 163, 166, 167

[56] References Cited

U.S. PATENT DOCUMENTS

| | | | |
|---|---|---|---|
| 1,625,229 | 4/1927 | Stollberg | 138/167 |
| 2,482,878 | 9/1948 | Schmidt | 432/234 |
| 2,693,352 | 11/1954 | Bloom | 432/234 |
| 4,225,307 | 9/1980 | Magera | 432/234 |

*Primary Examiner*—John J. Camby

*Attorney, Agent, or Firm*—William J. Ruano

[57] ABSTRACT

Skid pipe insulation for water cooled support piping in a reheating furnace comprising refractory complementary sleeves extending about 270° around the cooling pipe. The sleeves are bolted together at one end and the other ends are provided with substantially U-shaped clips which are adapted to inter-engage with complementary clips integrally welded or otherwise secured to the outer surface of the cooling pipe, which clips also serve as cooling fins.

3 Claims, 3 Drawing Figures

REINFORCED INSULATION FOR WATER COOLED PIPES

This invention relates to a reinforced refractory insulating structure for use in reheating furnaces for heating metal billets and the like. It is useful for skid rails as well as crossovers and risers, associated with the skid rails.

An outstanding disadvantage of formerly used reinforced pipe insulation for skid rails and the like, such as exemplified in my prior U.S. Pat. No. 4,225,307, is that steel brackets forming a component part of the insulation must be welded to the water cooling pipe for each particular installation of the insulation, which is time consuming as well as expensive.

A further disadvantage is that such brackets are small and afford no heat dissipating properties.

An object of the present invention is to provide a novel refractory insulation sleeve and mounting means which is devoid of the above-named disadvantages.

A further object of the invention is to provide a fin-like structure on the water cooling pipe as well as on the inner surface of the refractory insulation ring to enable easy and quick attachment of the insulation onto the waterpipe, the fins on the pipe having the dual function in mounting the insulation as well as effecting a certain degree of heat radiation to more effectively cool the insulation.

Other objects or disadvantages of the invention will become more apparent from the following description taken with the accompanying drawing wherein.

Figure 1:
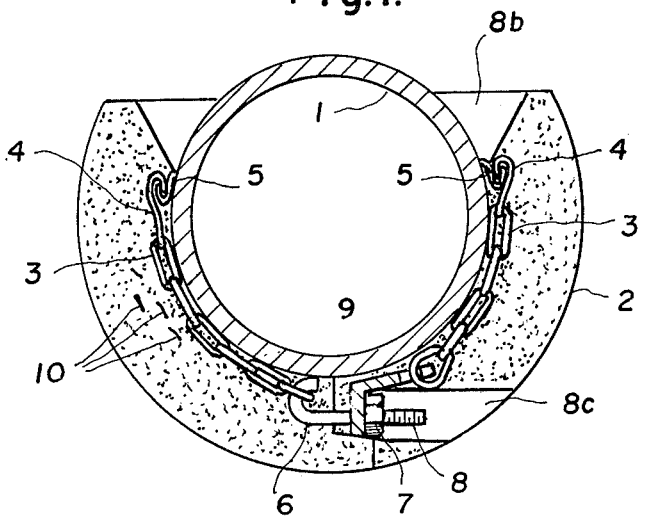
FIG. 1 is a transverse, cross-sectional view of the refractory insulation and mounting means on the cooling pipe embodying the present invention.

Referring more particularly to the drawing, numeral 1 denotes a cooling pipe through which cooling water will flow for reducing the temperature of the surrounding refractory insulation 2 which is made of any suitable refractory material for resisting high temperatures of about 2700° F. For example, the composition may be 80% alumina, 10% calcium oxide, 5% titanium, and the remainder iron oxides and impurities.

Tightly encircling and contacting the water pipe 1 is a reticulated wire fence-like structure 3 connected to clips 4 of metal, such as steel, (stainless) and forming a permanent part of the refractory insulating sleeve 1. The sleeve extends about 270° around cooling pipe 1.

Permanently attached, such as by welding to the outer surface of the cooling pipe, are U-shaped clips 5 which are detachable interlocked with complementary clips 4 for the purpose of mounting the two halves of the insulating pipes at one of the ends of said halves.

The other end of said halves may be tightly connected together by means of a J-bolt 6 including a nut 7 extending in a hole in the sleeve, which nut, when tightened onto threaded shank 8 against eye 9 will effect pulling together the ends of the reinforcing wire so as to place the wire under tension and in pre-stressed contacting relationship with the outer surface of pipe 1.

When it is desired to remove the refractory insulation from pipe 1, this can be easily and quickly done simply by unscrewing the nut 7 from the J-bolt 6 to loosen the tension on the reinforcing wire and then unhooking the clips 4,5 from each other. Of course, to mount a new refractory insulating sleeve, it is necessary to hook the clips 4, forming part of the insulation to those (5) welded to the pipe and thereafter tighten the nut to hold the reinforcing wire in tight engagement with the pipe and under tension. Fiberglass or other insulating fibers 10 are randomly dispersed in the insulating sleeve 1, particularly in the vicinity of the reinforcing wire mesh 3.

Figure 2:
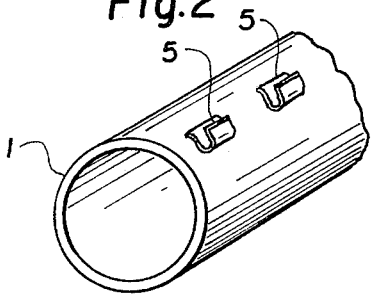
FIG. 2 is a perspective view of the cooling pipe showing the mounting clips which serve also as cooling fins.

FIG. 2 shows one form of the mounting clips, illustrated as a plurality of clips 5 in longitudinally spaced relationship for mating corresponding lengths of clips 4 in the refractory insulating sleeve, also serving as heat fins.

Figure 3:
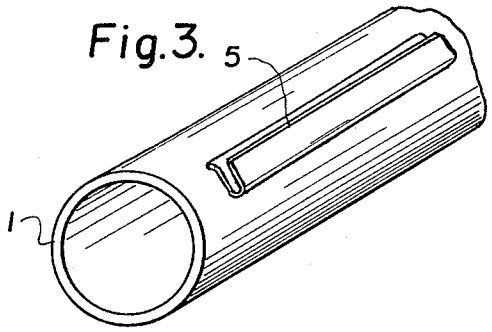
FIG. 3 shows a modification of the mounting clips and cooling fins shown in FIG. 2.

FIG. 3 shows a modification of the clip construction which extends longitudinally in a substantially continuous path, forming an effective heat radiating fin for transferring heat from the refractory insulating sleeve to the cooling water pipe 1 as well as to provide a permanently mounted clip on the pipe to enable easy and quick attachment of a mating or complementary clip involving part of the insulating sleeve.

Thus it will be seen that I have provided an efficient refractory insulating sleeve mounting for easy and quick attachment or detachment relative to a water-cooled pipe, comprising mating clips, one of the pair of which remains permanently welded to the pipe to serve also as a cooling fin for transferring heat from the insulating sleeve to the cooling pipe.

While I have illustrated and described a single specific embodiment of my invention, it will be understood that this is by way of illustration only and that various changes and modifications may be contemplated in my invention which are within the scope of the following claims.

I claim:

1. For use for heating insulating a fluid flowing cooling pipe in a furnace or the like, a pair of arcuate, prefabricated sleeve portions of refractory material, a metallic mesh embedded along the length of the inner surfaces of said sleeve portions and having parts thereof exposed and projecting beyond the inner surface of said refractory material so as to provide metallic contact with said pipe, a J-bolt hooked onto one end of said metallic mesh of one sleeve portion and embedded in said refractory material except for a threaded shank portion extending beyond said one end, and eye having an integral support embedded in one end of the adjacent sleeve portion and arranged so that said threaded shank extends through said eye, a hole in said one end of the adjacent sleeve portion, a nut projecting into said hole and screw threaded to said exposed shank to tightly hold together the adjacent end of said meshes of adjoining sleeve portions, terminal means connected to the other end of said meshes and comprising substantially U-shaped clips reversely bent in a circumferential direction and extending in a longitudinal direction and being integrally secured to the outer surface of said pipe for anchoring the other ends of said sleeve portions as well as serving as an attaching means for said clips permanently connected to said sleeve portions, whereby said metallic mesh may be tensioned upon tightening of said nut.

2. Apparatus as recited in claim 1 wherein said clips mounted on said pipe are of relatively short length and spaced along longitudinal paths.

3. Apparatus as recited in claim 1 wherein said clips permanently secured to the outer surface of said pipe are substantially continuous in longitudinal paths.

* * * * *